United States Patent [19]

Pherigo

[11] Patent Number: 4,634,019

[45] Date of Patent: Jan. 6, 1987

[54] CONTAINER WITH PLASTIC HINGE

[75] Inventor: Douglas E. Pherigo, Loves Park, Ill.

[73] Assignee: J. L. Clark Manufacturing Co., Rockford, Ill.

[21] Appl. No.: 840,409

[22] Filed: Mar. 14, 1986

[51] Int. Cl.[4] ..... B65D 43/14; B65D 51/04

[52] U.S. Cl. ..... 220/334

[58] Field of Search ..... 220/334, 337, 339, 340

[56] References Cited

U.S. PATENT DOCUMENTS

| | | | |
|---|---|---|---|
| 3,592,354 | 7/1971 | Nielsen | 220/334 |
| 4,089,467 | 5/1978 | McKowicki | 220/334 |
| 4,154,362 | 5/1979 | McKenney | 220/334 |
| 4,471,881 | 9/1984 | Foster | 220/339 |

*Primary Examiner*—George T. Hall

*Attorney, Agent, or Firm*—Leydig, Voit & Mayer, Ltd.

[57] ABSTRACT

A metal container cover is swingably connected to a metal container body by a hinge which consists of a single-piece extrusion of resiliently yieldable plastic. The hinge is generally S-shaped in transverse cross-section and includes upper and lower hook sections adapted to be snap-assembled with the body and the cover, respectively. A slot in the cover accommodates the lower hook section to enable the cover to swing to an open position.

8 Claims, 6 Drawing Figures

CONTAINER WITH PLASTIC HINGE

BACKGROUND OF THE INVENTION

The invention relates to a container having a body for holding a product and having a cover for closing the body. More particularly, the invention relates to a container of the type in which the body is formed with an upper lip portion defining an opening of predetermined size and shape. The cover is shaped as an inverted dish and includes a skirt depending from the periphery of a top wall having the same general size and shape as the opening in the body. When the cover is in a closed position, the top wall closes the opening of the body while the skirt telescopes downwardly over the lip portion of the body.

The invention is especially concerned with a container of the foregoing type in which a plastic hinge connects the cover to a body to swing between open and closed positions. Such a container is disclosed in Foster U.S. Pat. No. 4,471,881. In that container, the plastic hinge is injection molded and comprises a pair of swingably connected mounting leafs adapted to be joined to the lip portion of a metal body and to the skirt of the cover. To secure the mounting leaf to the metal body, it is necessary to form holes in the lip portion of the body, to insert lugs on the mounting leaf into the holes and then to upset the ends of the lugs. A similar assembly technique is used for the mounting leaf of the cover when the cover also is made of metal.

SUMMARY OF THE INVENTION

The general aim of the present invention is to provide a container having a new and improved plastic hinge which is simpler to manufacture than prior hinges of the same general type and which may be assembled with the body and the cover in a quicker and easier manner.

A more detailed object of the invention is to achieve the foregoing by providing a plastic hinge which is formed as a single-piece extrusion and which is adapted to be attached to both the body and the cover with a simple snap fit.

The invention also resides in the unique shape of the hinge and in the novel construction of the lip portion of the body and the skirt of the cover to enable assembly of the hinge by a simple snap-on operation, to enable the hinge to fit compactly between the cover and the body and to enable free swinging of the cover between open and closed positions.

These and other objects and advantages of the invention will become more apparent from the following detailed description when taken in conjunction with the accompanying drawings.

DETAILED DESCRIPTION OF THE PREFERRED EMBODIMENTS

Figure 1:
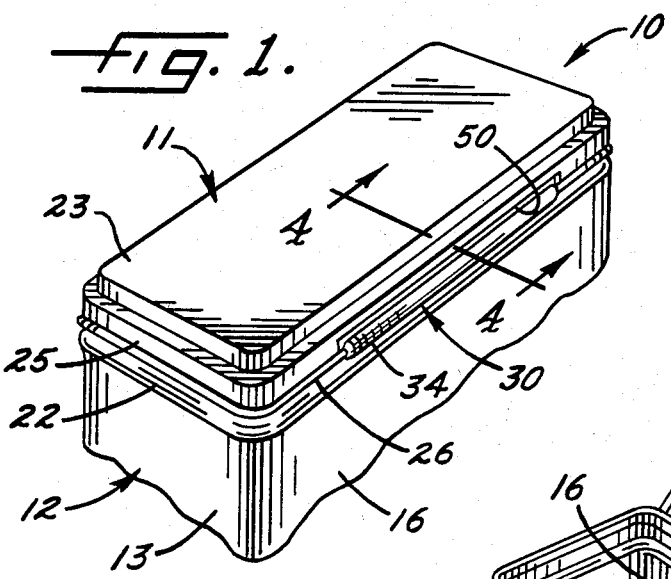
FIG. 1 is a rear fragmentary perspective view of one embodiment of a container equipped with a new and improved hinge incorporating the unique features of the present invention, the cover of the container being shown in a closed position.
Figure 2:
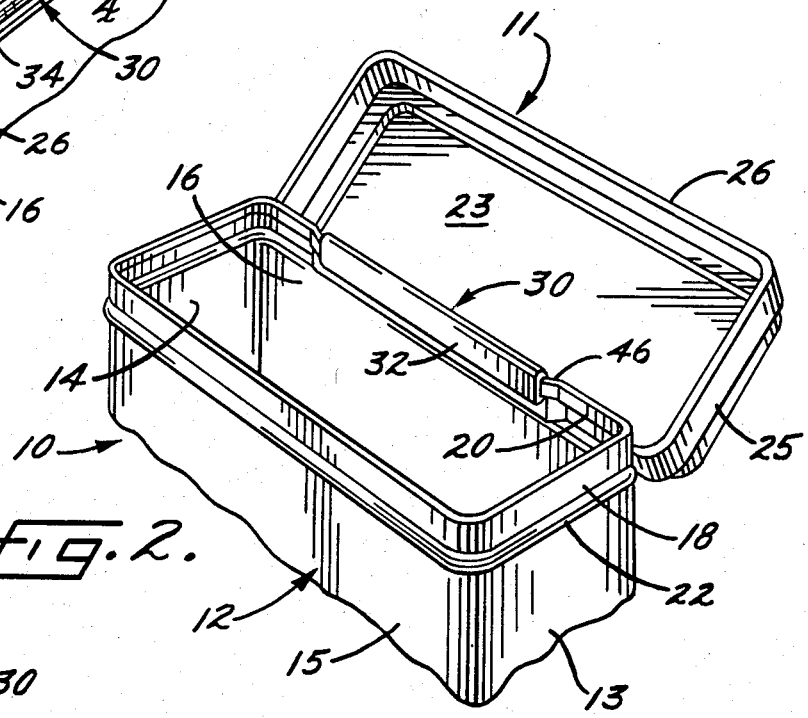
FIG. 2 is a front fragmentary perspective view of the container, the cover being shown in an open position.

As shown in the drawings for purposes of illustration, the invention is embodied in a container 10 having a cover 11 swingable between a closed position (FIG. 1) and an open position (FIG. 2) in which a box-like body 12 of rectangular cross-section is completely exposed. In the present instance, the body is made of sheet metal and includes two end walls 13 and 14 and two somewhat longer front and rear walls 15 and 16. At the corner between the end wall 13 and the rear wall 16, the ends of the sheet metal are locked together by a conventional seam (not visible). A bottom member (not shown) which also preferably is made of metal is secured to the lower end of the body 12.

Extending around the upper periphery of the body 12 is an inwardly offset lip portion 18 (FIG. 3) whose upper margin is folded inwardly into the body and then downwardly alongside the body to form a substantially flat hem 20 within the body. The extreme upper end of the body thus is rounded and is free of sharp edges while the lower end of the hem 20 defines a downwardly facing edge 21 (FIG. 4) within the body.

Located between the lip portion 18 and the main portion of the body 12 is a peripheral bead 22 which is formed by deforming the metal of the body outwardly. The bead is located some distance below the lower edge 21 of the hem 20.

The cover 11 also is preferably made of sheet metal and includes a substantially flat top wall 23 having generally the same rectangular size and shape as the interior of the body 12. Formed integrally with and depending from the periphery of the top wall 23 is a skirt 25 whose lower end is curled outwardly, upwardly and then inwardly so as to define an outwardly protruding peripheral bead 26 (FIGS. 3 and 4) of generally circular cross-section at the lower end of the skirt. When the cover is in its closed position on the body, the skirt 25 telescopes downwardly over the lip portion 18 of the body with the lower side of the bead 26 being located adjacent the upper side of the bead 22. The skirt 25 resiliently embraces the lip portion to hold the cover snugly but releasably in its closed position.

In accordance with the present invention, the cover 11 is mounted to swing between open and closed positions on the body 12 by a single-piece hinge 30 extruded from plastic and adapted to be assembled with both the cover and the body with a snap fit. As a result of forming the hinge as an extrusion, the hinge may be manufactured in a relatively simple manner and at relatively high speeds and may be easily made in different lengths for containers of different sizes. Assembly of the hinge to the cover and the body is simplified significantly by virtue of the fact that the hinge may be simply snapped in place and, as an incident thereto, holds the cover in hinged relation with the body.

Figure 4:
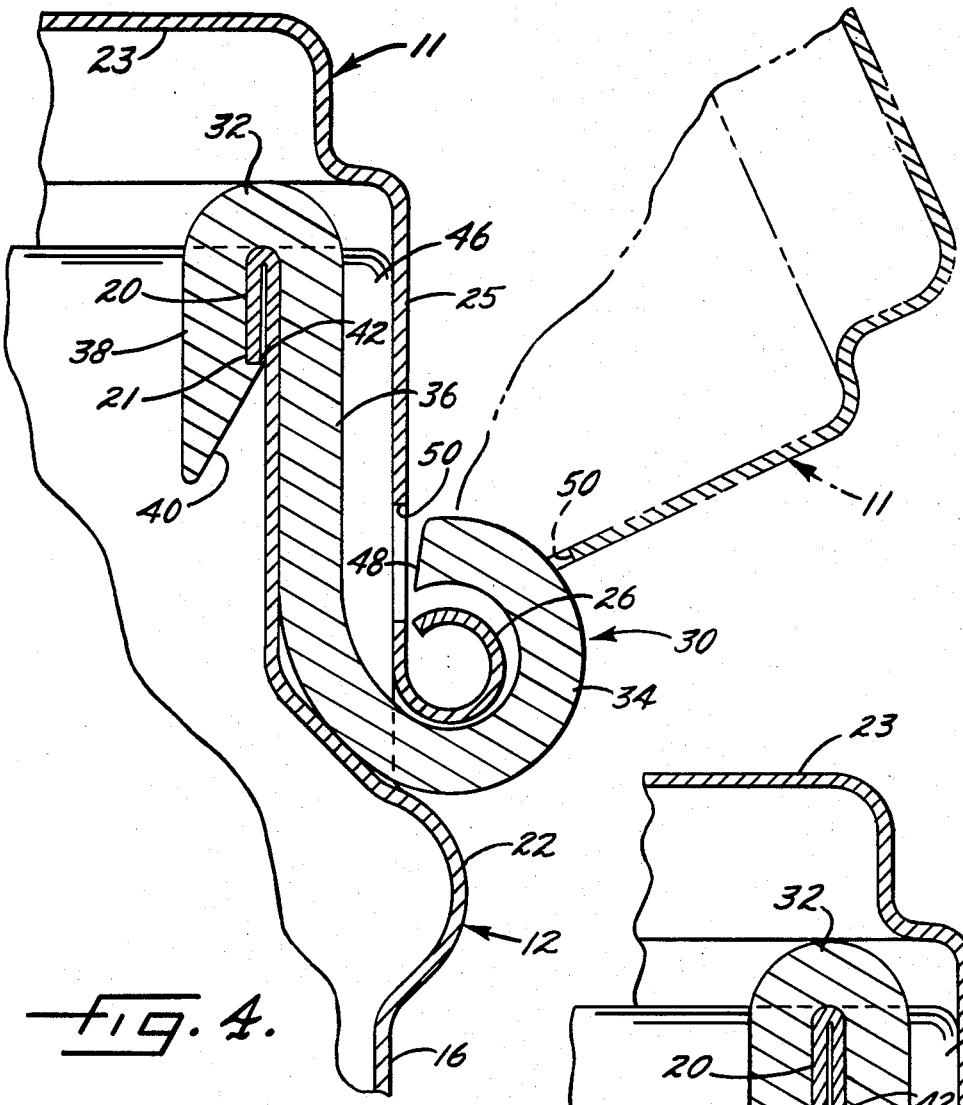
FIG. 4 is an enlarged fragmentary cross-section taken substantially along the line 4—4 of FIG. 1.
Figure 5:
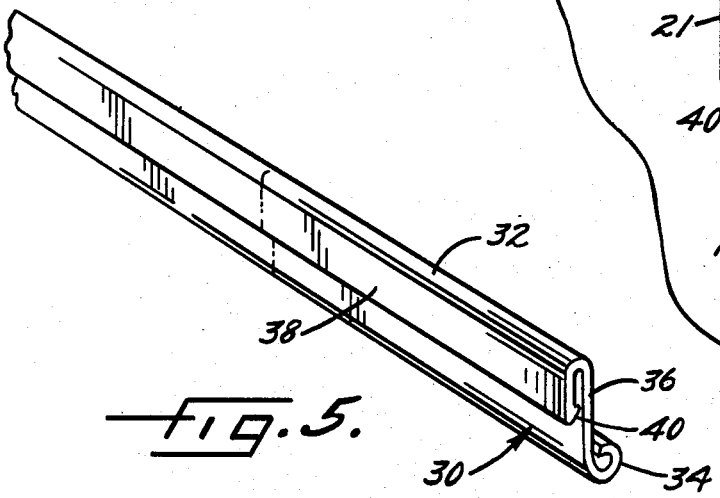
FIG. 5 is a fragmentary perspective view of the hinge.

More specifically, the present hinge 30 is made of high impact polystyrene and is formed by profile-extruding the plastic and then cutting the elongated extrusion into separate pieces each having a length equal to the required length of the hinge. The hinge is horizontally elongated in the direction of elongation of the lip portion 18 and, as shown in FIG. 4, is generally S-shaped in transverse cross-section. Thus, the hinge includes upper and lower hook sections 32 and 34 formed integrally with and located at the upper and lower ends, respectively, of an upright intermediate section 36.

The intermediate section 36 of the hinge 30 is flat and planar and is disposed in flat face-to-face relation with the outer surface of the lip portion 18 of the rear wall 16 of the body 12. The height of the intermediate section is approximately equal to the distance between the upper side of the bead 22 and the rounded upper end of the hem 20.

As shown in FIG. 4, the upper hook section 32 curves inwardly and then downwardly from the upper end of the intermediate section 36 and includes a flat and upright lower end portion 38 whose outer side lies substantially face-to-face with the inner side of the hem 20 of the rear wall 16. The outer side of the extreme lower end of the upper hook section is defined by a surface 40 which slopes upwardly and outwardly and whose upper terminus defines an upwardly facing shoulder 42.

When the hinge 30 is first formed and the plastic thereof is in a relaxed condition, the flat upright portion 38 of the upper hook section 32 is disposed in closely spaced relation with the intermediate section 36, the spacing being somewhat less than the thickness of the hem 20. To assemble the hinge 30 to the body 12, the upper hook section 32 is simply telescoped downwardly onto the hem 20 and, as an incident thereto, the inclined surface 40 engages the rounded upper end of the hem and cams the flat upright portion 38 outwardly against the resiliency of the plastic. As soon as the shoulder 42 clears the lower edge 21 of the hem, the flat upright portion 38 springs inwardly to cause the shoulder to snap beneath the edge. The flat upright portion 38 and the opposing intermediate section 36 resiliently grip the hem 20 to hold the hinge 30 on the body 12, and, in addition, the raw edge 21 of the hem bites into the shoulder 42 to restrict upward separation of the hinge from the body.

Advantageously, the intermediate section 36 of the hinge 30 is received within an inwardly offset recess 46 (FIGS. 2, 3 and 4) formed in the exterior of the lip portion 18 along the rear wall 16 of the body 12. The recess is formed by using coacting deforming dies (not shown) to inwardly offset an intermediate section of the lip portion from the adjacent end sections of the lip portion. The intermediate section 36 lies in flat face-to-face relation with the recessed section 46 of the lip portion 18 and has a thickness equal to or slightly less than the depth of the recess. By virtue of the recess, the intermediate section 36 of the hinge 30 lies substantially flush with the outer sides of the end sections of the rear lip portion 18 and does not interfere with the skirt 25 of the cover 11 when the cover is in its closed position. In addition, the length of the recess 46 is just very slightly greater than the length of the intermediate section 36 of the hinge and thus the ends of the intermediate section are engageable with the ends of the recess to restrict the hinge 30 against sliding lengthwise along the lip portion 18.

The lower hook section 34 of the hinge 30 first curves outwardly and upwardly from and then inwardly toward the lower end portion of the intermediate section 36 so as to define a curl having a circular cross-section and having an inner diameter somewhat greater than the outer diameter of the bead 26 of the skirt 25 (see FIG. 4). The free end 48 of the curl 34 is inclined upwardly and outwardly and is spaced outwardly from the outer side of the intermediate section 36 by a distance somewhat less than the outer diameter of the bead 26.

Assembly of the cover 11 and the hinge 30 is effected by moving the cover downwardly relative to the hinge to cause the bead 26 to snap into the lower curl 34. During such movement, the bead 26 cams against the free end 48 of the curl 34 to force that end away from the intermediate section 36 and permit the bead to enter the curl. Once the bead 26 clears the free end 48 of the curl 34, the latter springs back to its original condition so as to captivate the bead vertically in the curl.

Figure 6:
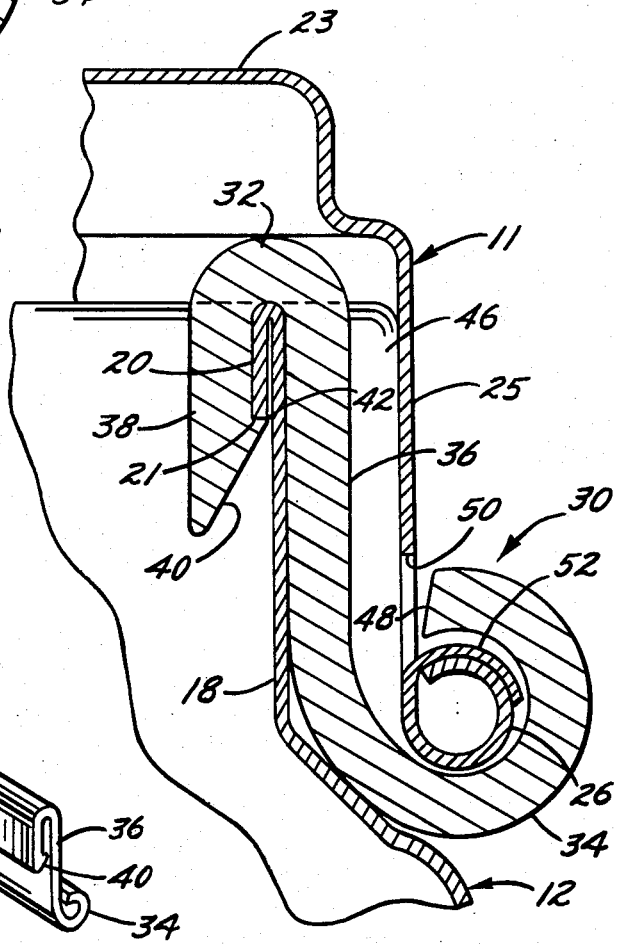
FIG. 6 is a view similar to FIG. 4 but shows a slightly modified container equipped with the hinge of the invention.

Because the bead 26 and the curl 34 are both formed with a circular cross-section, the bead is capable of pivoting within the curl to permit swinging of the cover 11. In keeping with the invention, interference between the skirt 25 and the curl 34 during such swinging is prevented by forming an elongated and generally rectangular slot 50 (FIGS. 3 and 4) through the skirt just above the bead 26. When the cover 11 is in its fully closed position as shown in solid lines in FIG. 4, the slot 50 is alined with and is spaced inwardly from the free end 48 of the curl 34. As the cover is swung to its open position shown in phantom lines in FIG. 4, the edges of the slot 50 move around the curl 34 to permit the skirt 25 to clear the curl and thereby prevent interference between the skirt and the curl. The slot 50 may be formed either by simply blanking out and completely removing a rectangular section of metal from the skirt (see FIG. 4) or by leaving the blanked out metal connected to the lower edge of the slot and curling such metal around the bead 26 as indicated at 52 in FIG. 6. In the latter case, the bead 26 is reinforced and stiffened by the curled metal 52 and is less likely to flex or deform when snapped into the curl 34 of the hinge 30 during assembly.

Figure 3:
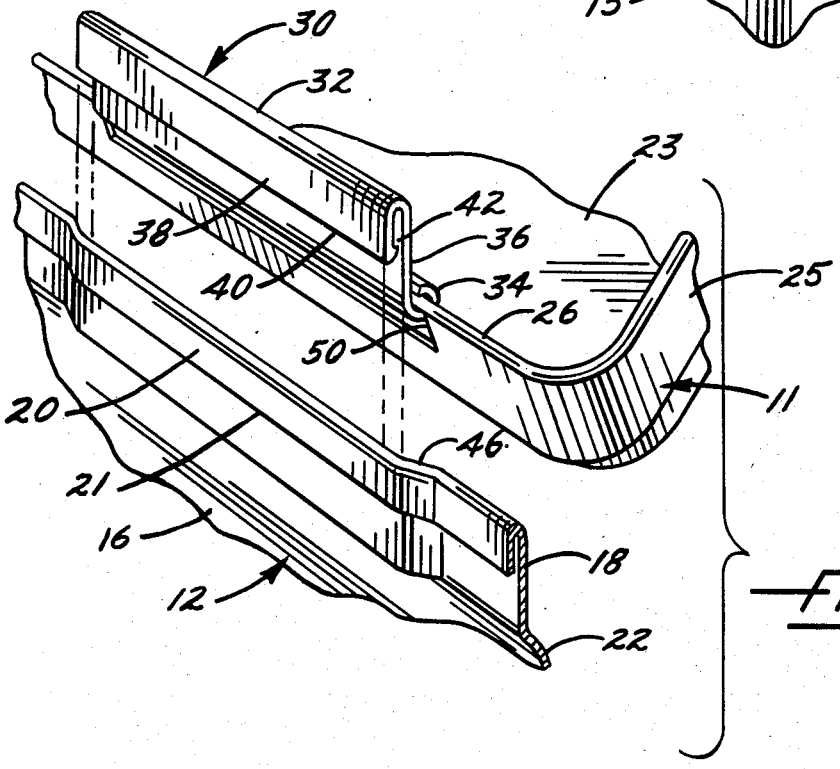
FIG. 3 is a fragmentary perspective view showing the hinge assembled with the cover and being assembled to the container body.

The preferred manner of assembly is to snap the bead 26 of the cover 11 into the curl 34 of the hinge 30 and then to snap the hinge with the attached cover onto the hem 20 of the body 12 (see FIG. 3). Alternatively, the hinge 30 may first be snapped onto the body 12 and then the bead 26 of the cover 11 may be snapped into the curl 34.

From the foregoing, it will be apparent that the present invention brings to the art a new and extremely simple plastic hinge which is especially useful for swingably connecting a metal cover 11 to a metal container body 12. Assembly of the components of the container 10 may be achieved quickly and easily since both the body and the cover are adapted to be attached to the hinge with a simple snap fit. Because the hinge initially is part of a continuous extrusion, hinges for containers of various sizes may be formed with the same extrusion dies, the extrusion then simply being cut into lengths appropriate for the different containers. With the intermediate section 36 of the hinge 30 being located in the inwardly offset recess 46 of the lip portion 18, the hinge axis defined by the bead 26 and the curl 34 may be located closely adjacent the rear wall 16 of the body 12 so as to enable the skirt 25 of the cover 11 to telescope over the lip portion with a snug fit when the cover is swung to its closed position.

I claim:

1. A container having a box-like body and having a cover for closing said body, said body having an upper lip portion defining an opening of predetermined size and shape, said cover being shaped as an inverted dish and having a top wall of the same general size and shape as said opening, a peripheral skirt formed integrally with and depending from said top wall and adapted to telescope over the lip portion of said body when said cover is in a closed position on said body, the lower end of said skirt being defined by an outwardly protruding peripheral bead, and a hinge for mounting said cover for swinging between open and closed positions on said body, said container being characterized in that said hinge consists of a singlepiece extrusion of resiliently yieldable plastic, said hinge being substantially S-shaped in transverse cross-section and having an upright intermediate section which lies substantially face-to-face with the outer side of said body adjacent the lip portion thereof, said hinge having an upper hook section formed integrally with the upper end of said intermediate section and curved inwardly and then downwardly therefrom, said upper hook section having a lower end portion which lies substantially face-to-face with the inner side of said lip portion and which coacts with said intermediate section to resiliently grip said lip portion and to hold said hinge on said body with a snap fit, said hinge having a lower hook section formed integrally with the lower end of said intermediate section and curved outwardly and then upwardly therefrom, said lower hook section being snapped resiliently around said bead and pivotally receiving said bead to support said cover for swinging between said positions, and a slot formed through said skirt above said bead and accommodating said lower hook section as said cover is swung to said open position thereby to prevent interference between said skirt and said lower hook section during such swinging.

2. A container as defined in claim 1 in which said lip portion has at least one elongated and substantially straight side, an intermediate portion of said one side of said lip portion being offset inwardly from the end portions of said one side of said lip portion so as to define a recess extending along the exterior of said one side of said lip portion, said recess being located in opposing relation with said slot when said cover is in said closed position, the intermediate section of said hinge being disposed in said recess and being located with its outer side disposed substantially flush with the outer sides of said end portions of said lip portion.

3. A container as defined in claim 2 in which the intermediate section of said hinge has approximately the same length as said recess, the ends of said intermediate section being engageable with the ends of said recess to restrict lengthwise sliding of said hinge along said lip portion.

4. A container having a box-like body and having a cover both made of sheet metal, said body having upright side walls which terminate in an upper lip portion defining an opening of predetermined size and shape, said cover being shaped as an inverted dish and having a top wall of the same general size and shape as said opening, a skirt formed integrally with and depending from the periphery of said top wall and adapted to telescope over the lip portion of said body when said cover is in a closed position, the lower end of said skirt being defined by an outwardly protruding peripheral bead of generally circular cross-section curled from the free edge of said skirt, said lip portion having at least one elongated and substantially straight side, an intermediate portion of said one side of said lip portion being offset inwardly from the end portions of said one side of said lip portion so as to define a recess extending along the exterior of said one side of said lip portion, said recess being located in opposing relation with the inner side of said skirt when said cover is in said closed position, a hinge consisting of a single-piece extrusion of resiliently yieldable plastic for mounting said cover for swinging between open and closed positions on said body, said hinge being elongated in the direction of said one side of said lip portion and being substantially S-shaped in transverse cross-section, said hinge having an upright and substantially flat intermediate section located within said recess and disposed in face-to-face relation with the outer surface of said lip portion, said hinge having an upper hook section formed integrally with the upper end of said intermediate section and curved inwardly and then downwardly therefrom, said upper hook section having an upright lower end portion which lies substantially face-to-face with the inner surface of said lip portion and which coacts with said intermediate section to resiliently grip said lip portion and to hold said hinge on said body with a snap fit, said hinge having a lower hook section formed integrally with the lower end of said intermediate section and curved outwardly and then upwardly therefrom, said lower hook section being snapped resiliently around said bead and pivotally receiving said bead to support said cover for swinging between said positions, and a slot formed through said skirt above said bead and disposed in opposing relation with said recess when said cover is in said closed position, said slot accommodating and moving around said lower hook section as said cover is swung to said open position thereby to permit said skirt to clear said lower hook section during such swinging.

5. A container as defined in claim 4 in which the lower end portion of said upper hook section is substantially flat and is disposed in closely spaced relation with the intermediate section of said hinge, said lower hook section being of generally circular cross-section and conforming substantially to said bead.

6. A container as defined in claim 5 in which said intermediate portion of said one side of said lip portion is defined by a substantially flat hem formed by folding the upper edge portion of said body inwardly into the body and then downwardly alongside the body, the free lower edge of said hem biting into the outer side of the lower end portion of said upper hook section to help captivate said hinge against upward removal from said lip portion.

7. A container as defined in claim 6 in which an upwardly facing shoulder is formed on the outer side of the lower end portion of said upper hook section, said shoulder camming past the lower edge of said hem as said upper hook section is telescoped onto said lip portion and then snapping outwardly beneath the lower edge of said hem.

8. A container as defined in claim 4 in which said hinge has approximately the same length as said recess and in which the ends of said hinge are engageable with the ends of said recess to restrict lengthwise sliding of said hinge along said lip portion.

* * * * *